United States Patent [19]

Wibell

[11] 4,132,262

[45] Jan. 2, 1979

[54] HEATING AND COOLING BLANKET

[76] Inventor: Joan Wibell, 342 E. 67th St., New York, N.Y. 10021

[21] Appl. No.: 759,797

[22] Filed: Jan. 17, 1977

[51] Int. Cl.[2] ..... F28F 7/00; F25B 29/00

[52] U.S. Cl. ..... 165/26; 62/261; 165/46; 219/212

[58] Field of Search ..... 165/46, 26; 62/261; 219/212

[56] References Cited

U.S. PATENT DOCUMENTS

| | | | |
|---|---|---|---|
| 2,504,308 | 4/1950 | Donkle, Jr. | 62/261 |
| 2,866,072 | 12/1958 | Smith | 219/212 X |
| 2,885,189 | 5/1959 | MacCracken | 219/212 X |
| 2,978,225 | 4/1961 | Dallas, Jr. | 219/212 X |
| 3,072,776 | 1/1963 | Quenneville | 219/212 |
| 3,634,655 | 1/1972 | Jordan | 219/212 X |
| 3,739,142 | 6/1973 | Johns | 219/212 |

*Primary Examiner*—Albert W. Davis, Jr.
*Attorney, Agent, or Firm*—Leonard W. Suroff

[57] ABSTRACT

A cooling and heating blanket comprising a blanket enclosure with heating means including a plurality of flexible elements positioned within the enclosure for being electrically energized for supplying heat to the enclosure, such that the enclosure may be retained above room temperature, and cooling means including a plurality of flexible fluid carrying conduits positioned within the enclosure through which a heat transfer fluid can flow, such that the enclosure may be retained below room temperature. Control means including an electric motor and a pump driven thereby located remotely relative to the enclosure is provided with flexible conduit means connecting the enclosure and the cooling means, and regulating means is operatively associated with the heating means and the cooling means. The regulating means being adapted to energize the control means or the heating means in response to increases and decreases of the temperature associated with the enclosure, such that the temperature of the blanket may be retained above or below the room temperature in which the blanket is located.

18 Claims, 5 Drawing Figures

HEATING AND COOLING BLANKET

BACKGROUND OF THE INVENTION

1. Field of the Invention

The present invention relates to a heating and cooling blanket that permits the user to selectively control the temperature at a level either below or above the room temperature in which it is used.

2. Description of the Prior Art

The prior art patents listed below deal with so-called electric blankets in which it is desired to furnish the necessary warmth to the user when using same. I have discovered that it is possible to provide in a single blanket the means for obtaining either heating or cooling, such that the person using the blanket may be effectively heated or cooled. Reference is generally made to a predetermined temperature level which for purposes of discussion may be the equivalent of the room temperature in which the blanket is used. Electric blankets as they are generally known, irrespective of the manner in which they are heated, are generally utilized to maintain the blanket at or above the room temperature.

In contrast to the above, there are those instances where it is desirable to obtain a cooling of the person such that the blanket may be used as a cooling blanket. The present invention in contrast to the devices illustrated in U.S. Pat. Nos. 2,617,915; 2,753,435; 2,802,088; 2,885,189; and 2,982,841, provides this flexibility.

I have also found that certain individuals, either due to medical reasons or poor circulation in their body, etc., require or need to have their body maintained at a temperature differential. In this manner there is a need to provide in a single blanket zones that coincide with various portions of the human body and which are independently adjustable as to temperature. For example, if a person has poor circulation in their feet, they may wish the lower zone of the blanket maintained at an elevated temperature in comparison to the upper zones of the blanket. The blanket of the present invention permits the cooling of one zone below room temperature while maintaining another zone above room temperature.

OBJECTS OF THE INVENTION

An object of the present invention is to provide a thermal blanket in which heat transfer means are provided such that desired heating or cooling can be obtained in the blanket.

Another object of the present invention is to provide a thermal blanket having respective independently controllable zones, such that the zones may either concurrently heat and cool the user of the blanket.

Another object of the present invention is to provide a thermal blanket having a plurality of zones, with the zones being independently adjustable as to a preselected temperature.

Other objects and advantages of the present invention will become apparent as the disclosure proceeds.

SUMMARY OF THE INVENTION

A cooling and heating blanket comprising a blanket enclosure with heating means including a plurality of flexible elements positioned within the enclosure for being electrically energized for supplying heat to the enclosure, such that the enclosure may be retained above room temperature, and cooling means including a plurality of flexible fluid carrying conduits positioned within the enclosure through which a heat transfer fluid can flow, such that the enclosure may be retained below room temperature.

Control means including an electric motor and a pump driven thereby located remotely relative to the enclosure is provided with flexible conduit means connecting the enclosure and the cooling means, and regulating means is operatively associated with the heating means and the cooling means. The regulating means being adapted to energize the control means or the heating means in response to increases and decreases of the temperature associated with the enclosure, such that the temperature of the blanket may be retained above or below the room temperature in which the blanket is located.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
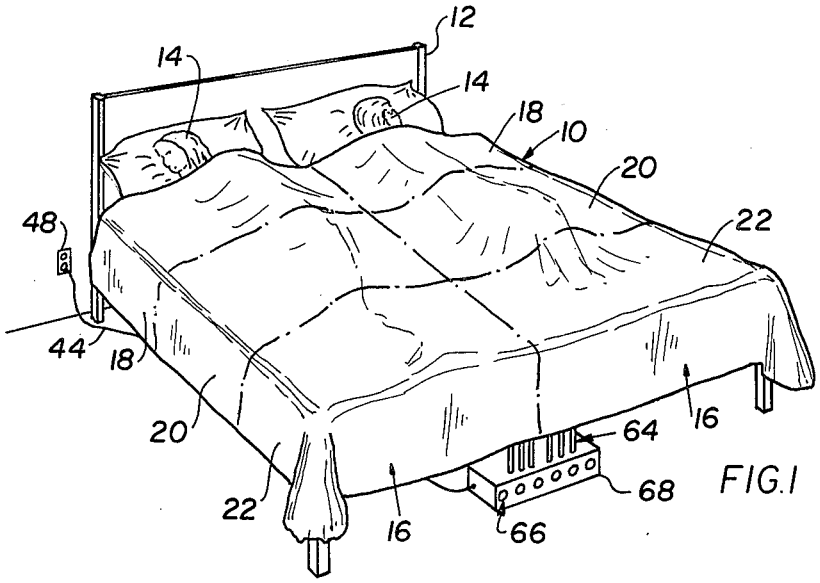
FIG. 1 is a perspective view illustrating an application of the cooling and heating blanket of the present invention.
Figure 2:
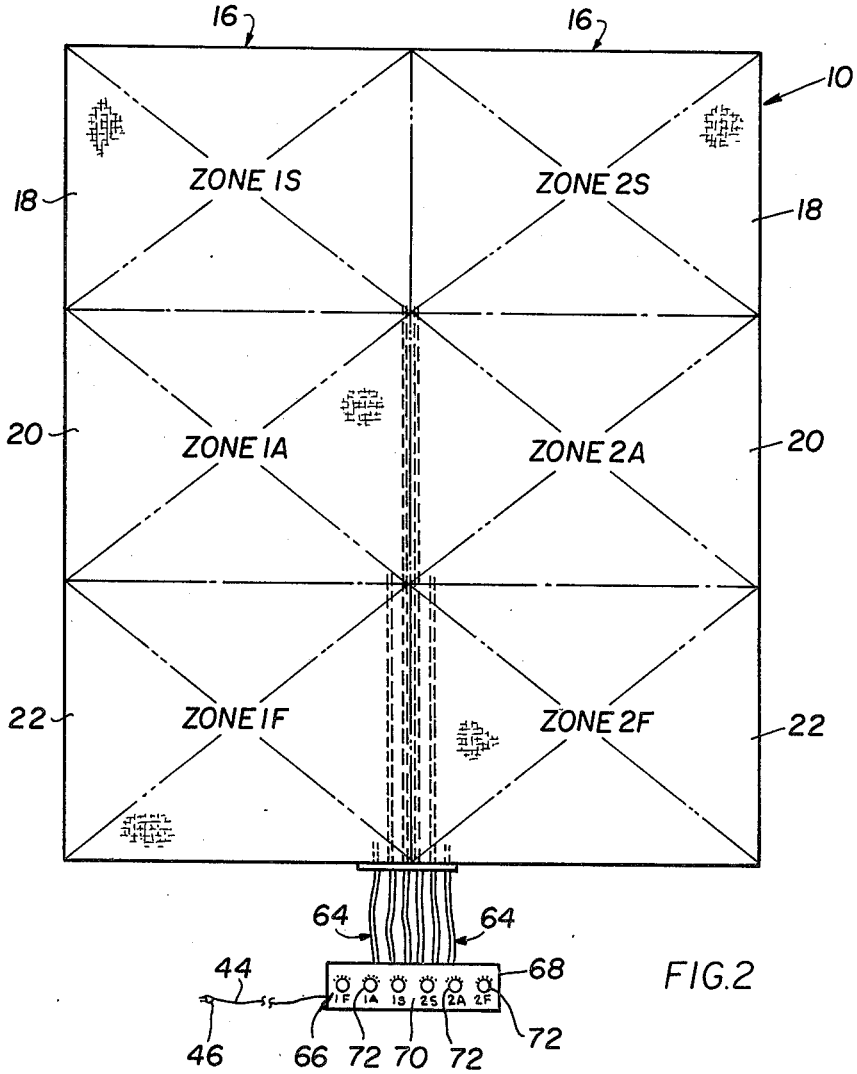
FIG. 2 is a plan view of the cooling and heating blanket of the present invention illustrating the various zones associated therewith and the control means for regulating the temperature of the zones.

Referring to the drawings, there is illustrated in FIGS. 1 through 5 a preferred embodiment of a cooling and heating blanket 10 that may take various sizes and shapes. In particular the embodiment illustrated in FIGS. 1 and 2 is for use with a double bed 12 in which two persons 14 are situated therein. The blanket 10 is divided into two major sections 16, with each section adapted to cover one of the persons 14.

The present invention permits selective regulation of either heating or cooling of the blanket, and for this purpose each section 16 may be divided into independent zones 18, 20, and 22, these zones being sometimes referred to as the upper, intermediate, and lower zones, respectively. The upper zone is designed to cover the upper torso of the body, the intermediate zone the lower section of the torso, and the lower zone for maintaining the legs of each person 14 covered. As can be appreciated by independently controlling the temperature of each of the zones 18, 20, and 22, there will exist a temperature differential between adjacent portions of the blanket 10. As previously explained, this temperature differential between respective zones on each section 16 may be selected as a result of the general desires of the person using the blanket 10, or due to medical reasons requiring use thereof.

Figure 5:
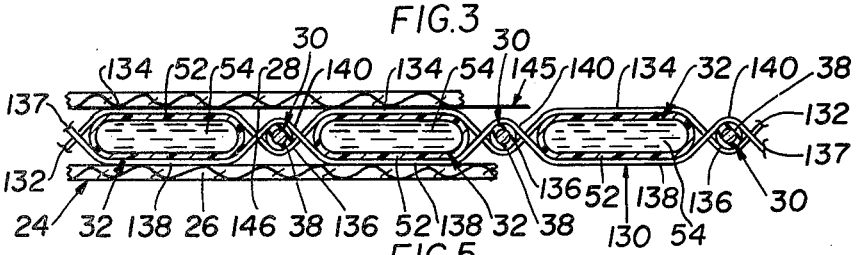
FIG. 5 is an enlarged sectional view taken on line 5—5 of FIG. 3.

Accordingly, the blanket 10 may be fabricated to cover a single bed for one person or the double bed 12, as illustrated. In addition, the blanket 10 may be used in the home, hospitals, nursing homes, etc. To retain the various devices necessary within the blanket 10, a blanket enclosure 24 is provided, as illustrated in FIG. 5, which is fabricated from an inner layer 26 and outer layer 28 of fabric material which forms the exterior surfaces of the enclosure 24. The fabric material 26 and 28 may be selected from a variety of material well known in the art, such as natural fibers or synthetic materials.

Each zone of the blanket 10 includes heating means 30 and cooling means 32 that are adapted to be automatically energized or deenergized depending upon preselected temperatures being reached. In addition, control means 34 is also associated with the heating means 30 and cooling means 32 to regulate same depending upon the desired temperatures. The total system for operation of the blanket 10 further includes regulating means 36 which is operatively associated with the heating means 30 and cooling means 32.

The regulating means 36 being adapted to energize the control means 34 or the heating means 30 in response to increases and decreases of the temperature associated with the enclosure 24, such that the temperature of the blanket 10 may be retained above or below the room temperature in which the blanket 10 is located.

Figure 3:
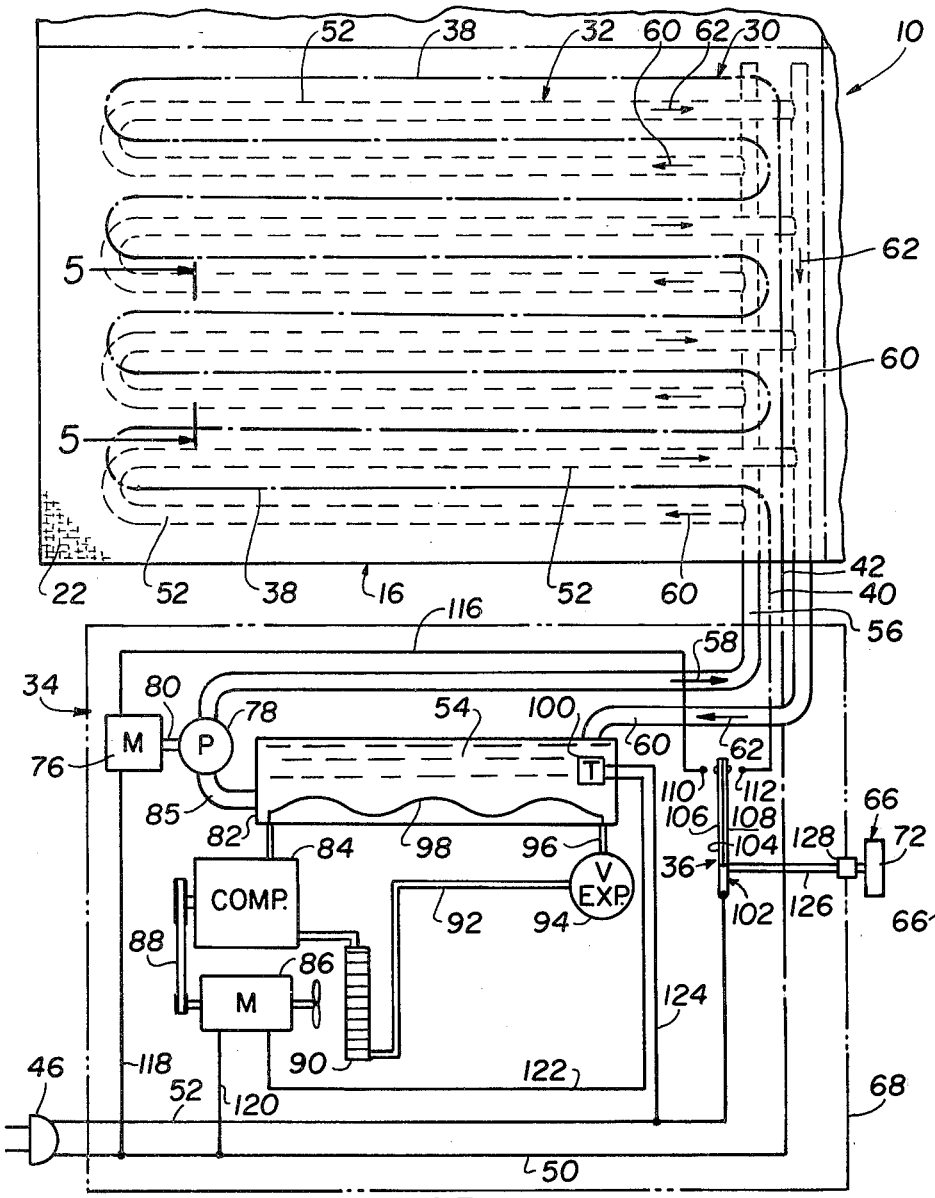
FIG. 3 is a schematic diagram illustrating the details of the cooling and heating means associated with each zone of the blanket.
Figure 4:
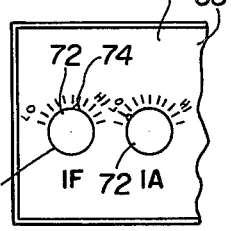
FIG. 4 is an enlarged fragmentary front view of the control panel for regulating selected temperatures.

With particular reference to FIG. 3, zone 22 is illustrated and the associated heating means 30 and cooling means 32 with respect to each zone is also illustrated. It is appreciated that one zone could be the equivalent of a complete blanket if one so desired. The heating means 30 includes a plurality of flexible insulated elements 38 positioned with the enclosure 24 for being electrically energized for supplying heat to the enclosure 24, such that the enclosure 24 may be retained above room temperature. The elements 38 may extend in substantially parallel spaced relationship to each other and may have an inner section 40 and an outer section 42 through which the heating element is energized.

The electric power for the blanket 10 is obtained from a power cord 44 having a plug 46 adapted to be received in a conventional wall outlet 48. The power cord 44 may include a power line 50 and 52, as illustrated in FIG. 3. The power line lead 50 may be connected to the power lead 42 of the heating means 30.

The cooling means 32 for each zone includes a plurality of flexible fluid carrying conduits 52 positioned within the enclosure 24 through which a heat transfer fluid 54 can flow, such that the enclosure 24 may be retained below room temperature. The conduits 52 may extend in parallel spaced relationship to each other and the fluid is transmitted to the conduits 52 by means of an input manifold 56 in which the fluid flows in the direction of arrow 58. An output manifold 60 is provided that is also connected to one end of the conduits 52 and through which the fluid flows in the direction of arrows 62.

In this manner fluid can be circulated through the zone 22 in a continuous flow pattern at a desired rate. The conduits 52 may be of a plastic material and readily contoured to conform to the shape of the user. The electric leads 40 and 42, as well as the manifolds 56 and 60, may be provided for one or more zones in flexible conduit means 64, as illustrated in FIG. 2. The conduit means 64 may extend to each of the respective zones 18, 20, and 22 in the blanket 10.

In order to permit the selective regulation of the individual zones, there may be provided adjusting means 66 operatively associated with each of the zones. The adjusting means 66 may be manually engageable by the user to preselect the desired temperature of a given zone. As illustrated in FIG. 2, a control housing 68 may be provided which includes a front panel 70 on which there is mounted a control knob 72, for each zone, with indicia means 74 calibrated on the front panel 70. Each knob 72 has appropriate identification for a given zone. For example, one section has the zone 18 identified as 1S, zone 20 as 1A, and zone 22 as 1F. The other section 16 has zone 18 identified as 2S, zone 20 as 2A and zone 22 as 2F. This provides ease in identification for the user of the temperature desired to be selected for a particular zone.

The control means 34 includes an electric motor 76 and a pump 78 connected thereto by connection 80. The input manifold 56 is connected to one side of pump 78 and the other side of pump 78 is connected to fluid reservoir 82 by conduit 85. The fluid reservoir 82 contains the fluid 54 to be pumped through the conduits 52.

The output manifold 60 communicates with the reservoir 82 for returning the fluid for recirculation. A compressor 84 is provided with a compressor motor 86 coupled thereto as by a pulley belt 88. A condenser 90 is operatively connected to compressor 84 and coupled by conduit 92 to an expansion valve 94 that is coupled by conduit 96 to reservoir 82 and the cooling coils 98 contained therein. A thermostat 100 may be positioned in the reservoir 82 for determining when the compressor 84 is to be energized or deenergized depending upon when the temperature of the fluid 54 falls below or rises above predetermined temperature levels.

The regulating means 36 includes a switch 102 having a bimetallic element 104 adapted to open and close the switch 102 in response to increases and decreases in the temperature of the bimetallic element 104, and the bimetallic element 104 being movable from one position in which the heating means 30 is electrically energized to another positioned in which the cooling means 32 is energized, such that the enclosure 24 may be maintained at the desired temperature.

The bimetallic element 104 includes metallic strips 106 and 108 spaced between electrical contacts 110 and 112 with one end of the strip or element 104 forming contact 114. Contact 114 is connected by lead 52 to the source of electrical current which may be 110 volts. Contact 110 is connected by lead 116 to motor 76 and motor 76 is connected by lead 118 to lead 50. In this manner when bimetallic element 104 engages contact 110, the circuit is closed and the cooling means 32 begins to function.

To obtain the heating means 30 to function bimetallic element 104 would engage contact 112 to close the circuit such that electrical energy passes through the resistive elements 38. Compressor motor 86 is connected by lead 120 to lead 50 and by lead 122 to thermostat 100. Thermostat 100 is connected by lead 124 to power lead 52. In this manner thermostat 100 controls the electrical functioning of the control means 34.

The user may regulate knob 72 which is mounted on a shaft 126 threadably engaged with a fitting 128 that may be contained on front panel 70. Shaft 126 may be connected to the base of bimetallic element 104 so as to move the bimetallic element 104 relative to the contacts 110 and 112. This regulates the desired temperature at which the heating means 30 or cooling means 32 will be activated. There are also those periods of time in which neither one may be activated.

To retain the conduits 52 and elements 38 in relatively fixed position to each other, there is provided fastening means 130 within the enclosure 24, as illustrated in FIG. 5. The fastening means 130 includes a first resilient strap 132 having alternate first sections 134 engaging the conduits 52 along one side thereof and first intermediate sections 136 integrally formed with and between the alternate first sections 134 for engagement with an oppositely disposed side of the flexible elements 38.

A second resilient strap 137 is mounted in interlocking relationship to the first resilient strap 132 by means of alternate second sections 138 engaging the conduits 52 along an oppositely disposed side as compared to the first sections 134 and second intermediate sections 140 integrally formed with and between the second sections 138 for engagement with an oppositely disposed side of the flexible elements 38 as compared to the first intermediate sections 136.

In this manner each one of the zones 18, 20, and 22 are independently controllable by the regulating means 36 such that different respective portions of the human body may be concurrently maintained at temperatures ranging from below to above room temperature by the heating means 30 and the cooling means 32. The control housing 68 may contain the various electromechanical devices required such as reservoir 82, motor 76, pump 78, etc., required to operate each of the respective zones 22. It is also contemplated that a single reservoir may in fact be used for all of the zones with separate input and output manifolds associated with the reservoir for the various zones. Accordingly, wherever possible a duplication of equipment need not be employed.

If desired, the reservoir and other apparatus required may be remotely located from the blanket 10 or adjacent thereto, as for example under the bed. The user can selectively and independently select the temperature desired for a respective zone prior to retiring for the evening. The equipment will then automatically function at the desired temperature level such that the cooling portion of the equipment is activated or the heating portion is activated.

In order to maximize the efficiency of the blanket 10, there is provided energy reflecting means 145 interposed between the fastening means 130 and the outer layer of fabric 28, as illustrated in FIG. 5. The energy reflecting means 145 may be in the form of an aluminum foil 146, or the like, that is ideally suited for its purpose of retaining the thermal energy inwardly towards the person. The foil 146 has the reflective surface necessary to perform its intended function. The individual straps 132 and 137 may be fabricated from a metallic material to aid in distribution of the thermal energy within the blanket in each of the respective zones.

It is appreciated that the novel blanket of the present invention permits alternate zones to be cooling or heating the person concurrently. This permits a variety of uses of the blanket, both for medical reasons as well as the desired comfort of the user. In this manner a substantial temperature differential may be present at different zones in the blanket in order to obtain the particular desired temperatures which may range from 50° F. to 110° F. Obviously, temperatures below and above this range may also be obtained.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A cooling and heating blanket comprising:

a. a blanket enclosure, b. heating means including a plurality of flexible elements positioned within said enclosure for being electrically energized for supplying heat to said enclosure, such that said enclosure may be retained above room temperature, c. cooling means including a plurality of flexible fluid carrying conduits positioned within said enclosure through which a heat transfer fluid can flow, such that said enclosure may be retained below room temperature, d. control means including an electric motor and a pump driven thereby located remotely relative to said enclosure, e. flexible conduit means connecting said enclosure and said cooling means, f. regulating means operatively associated with said heating means and said cooling means, said regulating means adapted to energize said control means or said heating means in response to increases and decreases of the temperature associated with said enclosure, such that the temperature of the blanket may be retained above or below the room temperature in which the blanket is located, g. said enclosure is divided into at least two major sections and each one of said sections may be independently regulated from said heating means or said cooling means, h. said major sections are each divided into respective zones, i. each one of said zones being independently controllable by said regulating means such that different respective portions of the human body may be concurrently maintained at temperatures ranging from below to above room temperature by said heating means and said cooling means, and j. said zones include:

(1) an upper zone for maintaining the upper torso of the body at a preselected temperature, (2) an intermediate zone for maintaining the lower torso at a preselected temperature, and (3) a lower zone for maintaining the legs at a preselected temperature.

2. A cooling and heating blanket as in claim 1, wherein a. said regulating means includes a switch having a bimetallic element adapted to open and close said switch in response to increases and decreases in the temperature of said bimetallic element, and b. said bimetallic element being movable from one position in which said heating means is electrically energized to another position in which said cooling means is energized, such that said enclosure may be maintained at the desired temperature.

3. A cooling and heating blanket as in claim 1, wherein said enclosure is adapted to be used by two persons, with each said major section coinciding with one half of said enclosure.

4. A cooling and heating blanket as in claim 1, wherein said regulating means is operatively associated with each one of said respective zones.

5. A cooling and heating blanket as in claim 1, including fastening means within said enclosure for maintaining said flexible elements and said conduits in substantially fixed spaced relationship to each other.

6. A cooling and heating blanket as in claim 5, wherein said enclosure includes spaced apart inner and outer layers of fabric material forming the exterior surfaces of said enclosure.

7. A cooling and heating blanket as in claim 6, including energy reflecting means interposed between said fastening means and said outer layer of fabric so as to aid in retaining the temperature level of said enclosure.

8. A cooling and heating blanket as in claim 5, said fastening means including:

a. a first resilient strap having alternate first sections engaging said conduits along one side thereof and first intermediate sections integrally formed with and between said alternate first sections for engagement with an oppositely disposed side of said flexible elements, and b. a second resilient strap mounted in interlocking relationship to said first resilient strap by means of alternate second sections engaging said conduits along an oppositely disposed side as compared to said first sections, and second intermediate sections integrally formed with and between said second sections for engagement with an oppositely disposed side of said flexible elements as compared to said first intermediate sections.

9. A cooling and heating blanket as in claim 1, wherein said control means includes:

a. a fluid reservoir having fluid therein for pumping through said conduits by said motor, b. a compressor, c. a condenser operatively connected to said reservoir and said compressor, d. a compressor motor for driving said compressor, and e. a thermostat in said reservoir for determining when said compressor motor is to be energized or deenergized depending upon when the temperature of the fluid falls below or rises above predetermined temperature levels.

10. A cooling and heating blanket as in claim 9, including an input manifold and an output manifold, said input manifold connected to said motor and to said conduits to supply fluid thereto, and said output manifold connected to said conduits and said reservoir for the return flow of the fluid.

11. A cooling and heating blanket comprising:

a. a blanket enclosure having at least upper and lower zones generally covering the torso and legs of the person using the blanket, b. heating means operatively associated with each of said zones, each of said heating means comprising a plurality of flexible elements positioned within said enclosure for being electrically energized for supplying heat to a respective zone of said enclosure, such that each one of said zones of said enclosure may be retained at relative temperatures, c. cooling means operatively associated with each of said zones, each of said cooling means comprising a plurality of flexible fluid carrying conduits positioned within each of said zones of said enclosure through which a heat transfer fluid can flow, such that each one of said zones of said enclosure may be retained at relative temperatures, d. control means operatively associated with each of said zones, each of said control means comprises an electric motor and a pump driven thereby located remotely relative to said enclosure, e. flexible conduit means connecting said enclosure and said cooling means, f. regulating means operatively associated with said heating means and said cooling means of each of said zones, each of said regulating means adapted to energize said control means or said heating means of a respective one of said zones in response to increases and decreases of the temperature associated with each one of said zones of said enclosure, so as to permit the temperature of said zones to be independently retained above or below predetermined temperature levels, such that the person using the blanket may obtain selective temperature levels for body comfort that may be concurrently maintained, g. fastening means within said enclosure for maintaining said flexible elements and said conduits in each of said zones in substantially fixed spaced relationship to each other, and h. said fastening means including:

(1) a first resilient strap having alternate first sections engaging said conduits along one side thereof and first intermediate sections integrally formed with and between said alternate first sections for engagement with an oppositely disposed side of said flexible elements, and (2) a second resilient strap mounted in interlocking relationship to said first resilient strap by means of alternate second sections engaging said conduits along an oppositely disposed side as compared to said first sections, and second intermediate sections integrally formed with and between said second sections for engagement with an oppositely disposed side of said flexible elements as compared to said first intermediate sections.

12. A cooling and heating blanket as in claim 11, including an intermediate zone interposed between said upper and lower zones for maintaining the lower torso at a preselected temperature.

13. A cooling and heating blanket as in claim 11, wherein a. said regulating means for each one of said zones includes a switch having a bimetallic element adapted to open and close said switch in response to increases and decreases in the temperature of said bimetallic element, b. said bimetallic element being movable from one position in which said heating means is electrically energized to another position in which said cooling means is energized, such that each of said zones of said enclosure may be maintained at the desired temperature, and c. adjusting means manually engageable by the user to preselect the desired temperature for a given zone.

14. A cooling and heating blanket as in claim 11, wherein said enclosure is divided into at least two major sections and each one of said sections having said zones therein and being independently regulated from said heating means or said cooling means, such that said enclosure is adapted to be used by two persons, with each said major section coinciding with one half of said enclosure.

15. A cooling and heating blanket as in claim 11, wherein said enclosure includes spaced apart inner and outer layers of fabric material forming the exterior surfaces of said enclosure.

16. A cooling and heating blanket as in claim 15, including energy reflecting means interposed between said fastening means and said outer layer of fabric so as to aid in retaining the temperature level of said enclosure.

17. A cooling and heating blanket as in claim 11, wherein said control means is operatively connected to each of said zones, and each said control means includes:

a. a fluid reservoir having fluid therein for pumping through said conduits by said motor, b. a compressor, c. a condenser operatively connected to said reservoir and said compressor, d. a compressor motor for driving said compressor, and e. a thermostat in said reservoir for determining when said compressor motor is to be energized or deenergized depending upon when the temperature of the fluid falls below or rises above predetermined temperature levels.

18. A cooling and heating blanket as in claim 17, including an input manifold and an output manifold, said input manifold connected to said motor and to said conduits to supply fluid thereto, and said output manifold connected to said conduits and said reservoir for the return flow of the fluid.

* * * * *